US010013970B2

(12) United States Patent
Fujisawa

(10) Patent No.: US 10,013,970 B2
(45) Date of Patent: Jul. 3, 2018

(54) SOUND EFFECT PRODUCING APPARATUS, METHOD OF PRODUCING SOUND EFFECT AND PROGRAM THEREFOR

(71) Applicant: YAMAHA CORPORATION, Hamamatsu-shi (JP)

(72) Inventor: Morishige Fujisawa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/603,631

(22) Filed: May 24, 2017

(65) Prior Publication Data

US 2017/0345409 A1 Nov. 30, 2017

(30) Foreign Application Priority Data

May 25, 2016 (JP) ..... 2016-104063

(51) Int. Cl.

| | |
|---|---|
| ***H04R 3/00*** | (2006.01) |
| ***G10K 15/08*** | (2006.01) |
| ***H04S 7/00*** | (2006.01) |
| ***G10K 15/12*** | (2006.01) |

(52) U.S. Cl.

CPC ..... *G10K 15/12* (2013.01); *H04S 7/305* (2013.01); *H04S 7/301* (2013.01); *H04S 7/302* (2013.01); *H04S 2400/11* (2013.01)

(58) Field of Classification Search

CPC . H04R 3/00; H04R 5/00; G10K 15/04; G10K 15/08; G10K 15/12; H04S 5/00; H04S 5/005; H04S 5/02; H04S 7/301; H04S 7/302; H04S 7/305; H04S 2400/11

See application file for complete search history.

(56) References Cited

U.S. PATENT DOCUMENTS

| | | | | |
|---|---|---|---|---|
| 5,680,464 | A | 10/1997 | Iwamatsu | |
| 2006/0177074 | A1* | 8/2006 | Ko | G10K 15/12 381/63 |
| 2008/0279389 | A1* | 11/2008 | Yoo | H04S 3/002 381/18 |

(Continued)

FOREIGN PATENT DOCUMENTS

| | | | |
|---|---|---|---|
| JP | H08-275300 | A | 10/1996 |
| JP | 2009037143 | A | 2/2009 |

*Primary Examiner* — Thang Tran

(74) *Attorney, Agent, or Firm* — Rossi, Kimms & McDowell LLP

(57) ABSTRACT

A sound effect producing apparatus includes an input portion, a memory portion, a pseudo sound reflection producing portion, and an effect provision portion. The input portion performs inputting of an audio signal. The memory portion stores sound effect information that includes production information for producing a pseudo sound reflection corresponding to a sound reflection generated in a predetermined acoustic space and sound source position information showing a sound source position of the pseudo sound reflection. The pseudo sound reflection producing portion produces a pseudo sound reflection based on the production information. The effect provision portion performs a process of localizing the pseudo sound reflection using a predetermined direction as a reference, based on the audio signal and the sound source position information.

13 Claims, 13 Drawing Sheets

(56) References Cited

U.S. PATENT DOCUMENTS

2010/0260355 A1* 10/2010 Muraoka ..... A63F 13/10
381/107
2010/0296658 A1* 11/2010 Ohashi ..... H04S 7/305
381/57
2015/0312690 A1* 10/2015 Yuyama ..... H04R 29/002
381/59
2016/0227342 A1* 8/2016 Yuyama ..... H04S 7/30

* cited by examiner

SOUND EFFECT PRODUCING APPARATUS, METHOD OF PRODUCING SOUND EFFECT AND PROGRAM THEREFOR

CROSS REFERENCE

This Nonprovisional application claims priority under 35 U.S.C. § 119(a) on Patent Application No. 2016-104063 filed in Japan on May 25, 2016, the entire contents of which are hereby incorporated by reference.

BACKGROUND OF THE INVENTION

1. Technical Field

Some preferred embodiments of the present invention relates to a sound effect producing apparatus that produces a sound effect to provide an audio signal with a sound field effect.

2. Description of the Related Art

Conventionally, as an apparatus for providing sound content with a sound field effect, for example, a sound field controller is described in JP H08-275300 A. The sound field effect is one that reproduces pseudo sound reflections (sound effect) that simulate sound reflections generated in an acoustic space such as concert hall and thereby causes listeners to experience a feeling of presence as if they were in a separate space such as real concert hall while being in a room.

FIG. 13A is a top view schematically showing an arrangement of speakers in a listening environment. FIG. 13B is a conceptual diagram showing a sound source distribution of a direct sound and pseudo sound reflections in a case where a sound field effect is provided. FIG. 13C is a diagram showing an impulse response of an acoustic space (a graph showing time of occurrences and levels of the direct sound and the pseudo sound reflections).

The sound field controller produces, from an inputted audio signal, audio signals that correspond to the pseudo sound reflections, based on sound field effect information corresponding to an acoustic space selected by a user (for example, a concert hall), and supplies the produced audio signals to respective speakers.

The sound field effect information includes an impulse response of an acoustic space generating a group of sound reflections (see FIG. 13C), and information showing sound source positions of the group of sound reflections. The sound field controller, based on the sound field effect information, convolutes the inputted audio signal with the impulse response, changes gain ratios and amounts of delay of the audio signals to be supplied to the respective speakers, and thereby produces a group of pseudo sound reflections at a plurality of positions as shown in FIG. 13B.

However, the sound source positions of the group of sound reflections are predetermined correspondingly to the acoustic space that has been chosen. Therefore, for example, even when a sound source position of the direct sound moves, sound source positions of the group of sound reflections never move following the former's movement.

Thus, some preferred embodiments of the present invention are directed to providing a sound effect producing apparatus capable of moving sound source positions of a group of sound reflections.

SUMMARY OF THE INVENTION

A sound effect producing apparatus according to preferred embodiments of the present invention includes an input portion, a memory portion, a pseudo sound reflection producing portion, and an effect provision portion. The input portion performs inputting of an audio signal. The memory portion stores sound effect information that includes production information for producing a pseudo sound reflection corresponding to a sound reflection generated in a predetermined acoustic space and sound source position information showing a sound source position of the pseudo sound reflection. The pseudo sound reflection producing portion produces a pseudo sound reflection based on the production information. The effect provision portion performs a process of localizing the pseudo sound reflection using a predetermined direction as a reference, based on the audio signal and the sound source position information.

And thus, the sound effect producing apparatus according to preferred embodiments of the present invention makes it possible to move sound source positions of a group of sound reflections.

DETAILED DESCRIPTION OF THE PREFERRED EMBODIMENTS

A sound effect producing apparatus according to an embodiment of the present invention includes an input portion, a memory portion, a pseudo sound reflection producing portion, and an effect provision portion. The input portion performs inputting of an audio signal. The memory portion stores sound effect information that includes production information for producing pseudo sound reflections corresponding to sound reflections generated in a predetermined acoustic space and sound source position information showing sound source positions of the pseudo sound reflections. The pseudo sound reflection producing portion produces pseudo sound reflections based on the production information. The effect provision portion performs a process of localizing the pseudo sound reflections using predetermined directions as references, based on the audio signal and the sound source position information.

In this manner, the sound effect producing apparatus localizes a position of a pseudo sound reflection using a predetermined direction as a reference. For example, as for a right channel, a pseudo sound reflection is localized using a direction of 45° to the right as a reference. As for a left channel, a pseudo sound reflection is localized using a direction of 45° to the left as a reference. For the purpose of localizing the pseudo sound reflections using predetermined directions as references, the effect provision portion may offset the sound source position information, or the memory portion may store a plurality of pieces of the sound source position information that have been respectively offset beforehand in the right direction and in the left direction. This enables the sound source positions of a group of sound reflections to change, thereby producing a sense of direction also in a sound field effect.

Figure 1:
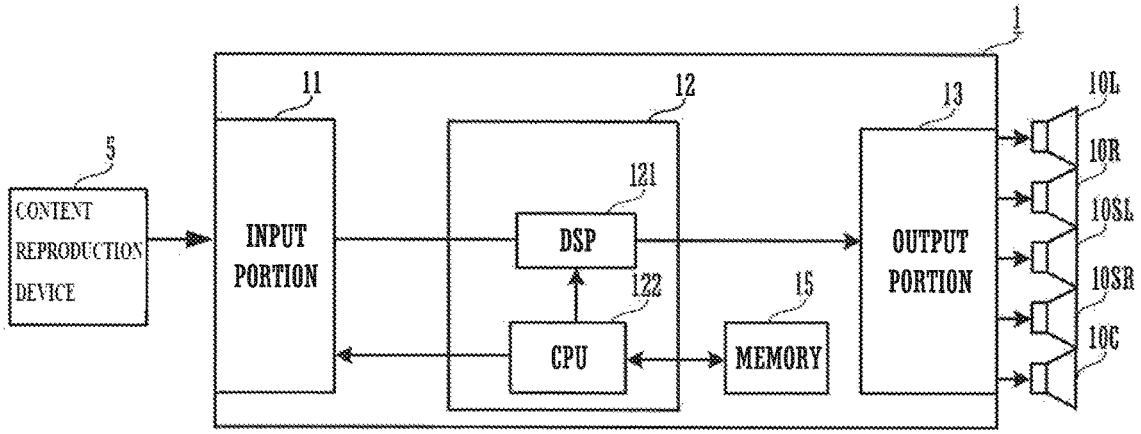
FIG. 1 is a block diagram showing a configuration of an audio system and an audio signal processing apparatus.
Figure 2:
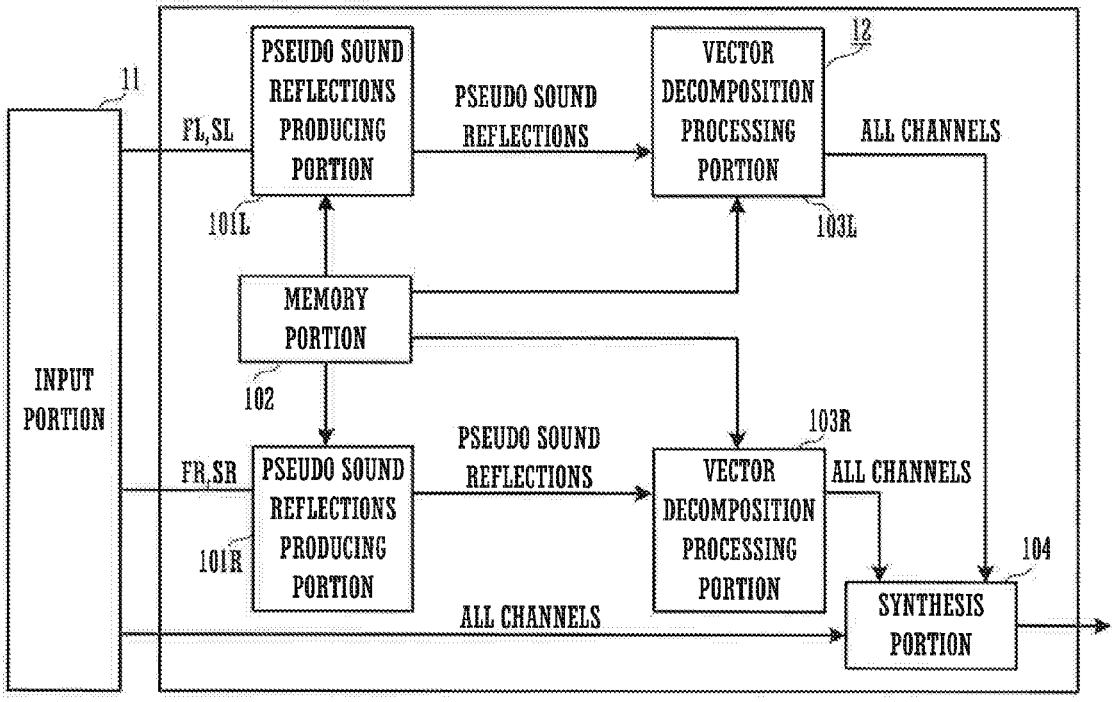
FIG. 2 is a functional block diagram of a processing portion.
Figure 3:
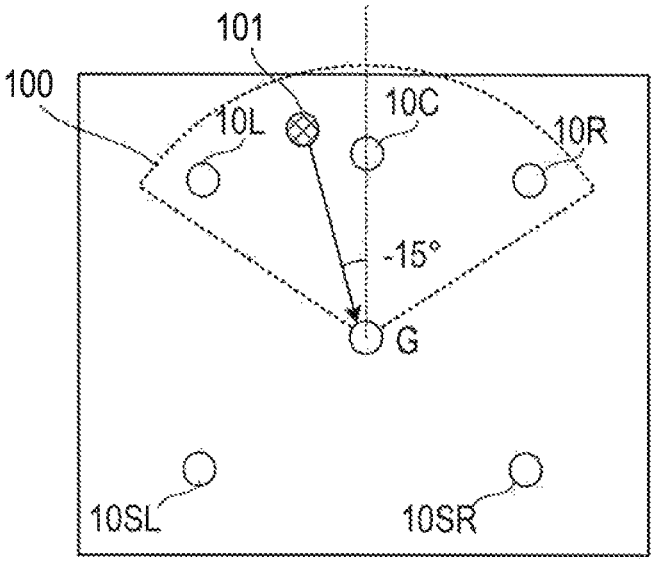
FIG. 3 is a top view schematically showing a listening environment.

FIG. 1 is a block diagram showing a configuration of an audio system and an audio signal processing apparatus. FIG. 2 is a functional block diagram of a processing portion. FIG. 3 is a top view schematically showing a listening environment.

The audio system includes an audio signal processing apparatus 1, a content reproduction device 5, and a plurality of speakers 10 (speaker 10L, speaker 10R, speaker 10SL, speaker 10SR and speaker 10C).

The plurality of speakers 10 are installed, as shown in FIG. 3, around a listening position G in the listening environment. In this example, the speaker 10C is installed in front of the listening position (hereinafter, front of the listening position is referred to as 0° in azimuthal angle, which becomes positive in clockwise direction); the speaker 10R is installed in right front (at 45° in azimuthal angle) of the listening position; the speaker 10SR is installed in right rear (at 135° in azimuthal angle) of the listening position; the speaker 10SL is installed in left rear (at 225° in azimuthal angle) of the listening position; and the speaker 10L is installed in left front (at 315° in azimuthal angle) of the listening position.

The audio signal processing apparatus 1 corresponds to the sound effect producing apparatus of the present invention, and consists of, for example, an audio receiver. Apart from the audio receiver, the sound effect producing apparatus of the present invention can be realized by, for example, an information processing apparatus such as personal computer.

The audio signal processing apparatus 1 includes an input portion 11, a processing portion 12, an output portion 13, a CPU 14 and a memory 15. The processing portion 12 includes a DSP 121 and a CPU 122.

The input portion 11 receives content data from the content reproduction device 5, and outputs an audio signal that is extracted from the content data to the DSP 121. To the input portion 11, as an example, multi-channel audio signals for left front (LF) channel, right front (RF) channel, center (C) channel, left surround (SL) channel and right surround (SR) channel are inputted. Here, the input portion 11, when receiving an analog signal, also has a function of converting thereof into a digital signal to output.

The CPU 122 reads out a program stored in the memory 15, and performs a control of the input portion 11 and the DSP 121. With the program, the CPU 122 causes the DSP 121 to perform a process of producing the sound effect, and thus the sound effect producing apparatus is realized.

According to the control by the CPU 122, the DSP 121 applies a predetermined processing to the audio signal that is inputted from the input portion 11. Here, the DSP 121 carries out a process of producing the sound field effect, as mentioned above.

FIG. 2 is a functional block diagram of the processing portion 12. The processing portion 12 includes a pseudo sound reflection producing portion 101L, a pseudo sound reflection producing portion 101R, a memory portion 102, a vector decomposition processing portion 103L, a vector decomposition processing portion 103R and a synthesis portion 104.

The pseudo sound reflection producing portion 101L and the pseudo sound reflection producing portion 101R produce pseudo sound reflections from the inputted audio signals.

The pseudo sound reflections are produced based on sound field effect information stored in the memory portion 102. The sound field effect information includes: production information (impulse response) for producing pseudo sound reflections corresponding to sound reflections generated in a predetermined acoustic space; and the sound source position information showing localization positions of a group of pseudo sound reflections. The impulse response includes, specifically, delay time from a direct sound (information showing the timing of occurrences), and information showing ratios of levels of the sound reflections to a level of the direct sound (information showing levels). Also, in the memory portion 102, information showing positions of the respective sound reflections (sound source position information) is stored. Further, although the memory portion 102 is built-in the processing portion 12 (DSP 121 or CPU 122) in this example, actually, another storage medium such as the memory 15 or the like corresponds to the memory portion 102.

The pseudo sound reflection producing portion 101L and the pseudo sound reflection producing portion 101R read out, from the memory portion 102, an impulse response corresponding to an acoustic space chosen by a user, and produce pseudo sound reflections based on the read-out impulse response.

The pseudo sound reflection producing portion 101L accepts audio signals for left channels (in this example, FL channel and SL channel) as input, and produces pseudo sound reflections for the left channels by convoluting the audio signals for the left channels with the impulse response. The produced pseudo sound reflections for the left channels are inputted to the vector decomposition processing portion 103L.

The pseudo sound reflection producing portion 101R accepts audio signals for right channels (in this example, FR channel and SR channel) as input, and produces pseudo sound reflections for the right channels by convoluting the audio signals for the right channels with the impulse response. The produced pseudo sound reflections for the right channels are inputted to the vector decomposition processing portion 103R.

The vector decomposition processing portion 103L and the vector decomposition processing portion 103R correspond to the effect provision portion of the present invention. The vector decomposition processing portion 103L and the vector decomposition processing portion 103R perform a process of localizing the pseudo sound reflections by changing distribution gain ratios for the audio signals to be supplied to the respective speakers (channels), based on the sound source position information that has been read-out from the memory portion 102.

For example, as shown in FIG. 3, when the audio signals are provided to the speaker 10L and the speaker 10R with predetermined amounts of delay and a predetermined gain ratio (for example, a greater gain to the speaker 10L side), a pseudo sound reflection 101 is localized at a predetermined position (for example, at an angle near −15° on the left side of the front of the listening position G).

In this manner, the vector decomposition processing portion 103L and the vector decomposition processing portion 103R perform the process of localizing the pseudo sound reflections at predetermined positions by distributing the inputted pseudo sound reflections to the respective channels with predetermined gain ratios. Then, the synthesis portion 104 combines the audio signals output from the vector decomposition processing portion 103L and the vector decomposition processing portion 103R with the audio signals inputted from the input portion 11, for the respective channels. The synthesis portion 104 outputs audio signals that have been synthesized for the respective channels to the output portion 13.

The output portion 13 supplies the audio signals for the respective channels that are output from the synthesis portion 104 to the speakers 10L, 10R, 10C, 10SL, and 10SR that correspond to the respective channels. This causes the pseudo sound reflections to be localized at predetermined positions. Thus, a domain 100 having a sound field effect is formed in front of the listening position G.

Then, the vector decomposition processing portion 103L and the vector decomposition processing portion 103R of this embodiment perform a process of changing the sound source position information using predetermined directions as references.

Figure 4:
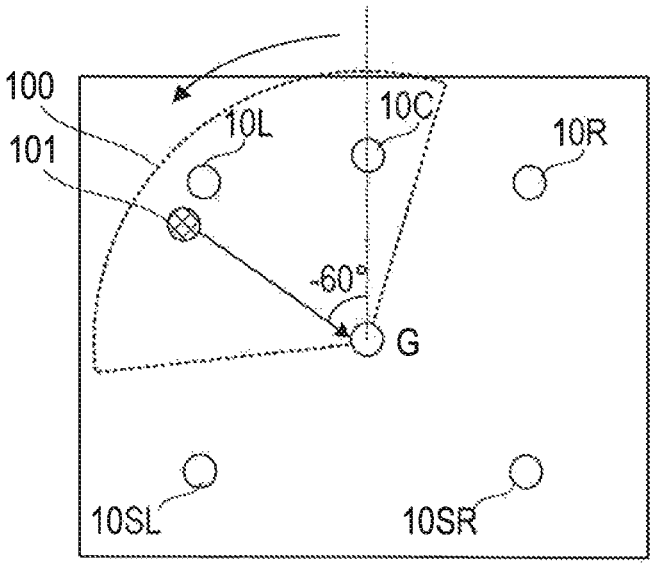
FIG. 4 is a top view schematically showing a listening environment.
Figure 5:
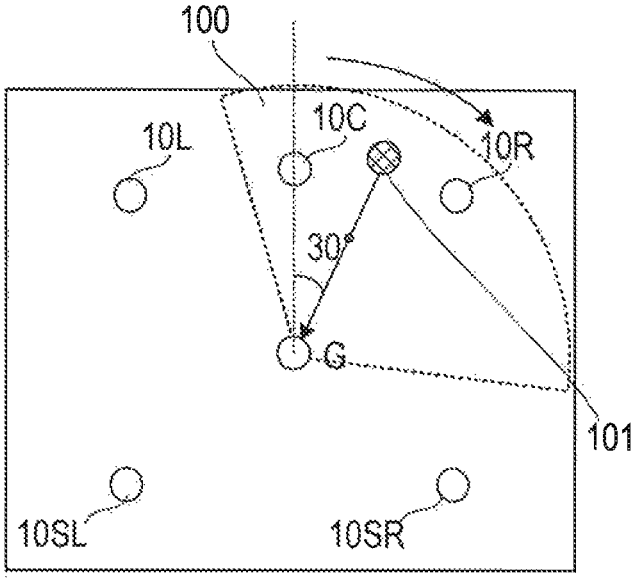
FIG. 5 is a top view schematically showing a listening environment.

FIG. 4 is a diagram showing, in a top view schematically showing a listening environment, a sound field effect produced through the processing by the vector decomposition processing portion 103L. FIG. 5 is a diagram showing, in a top view schematically showing a listening environment, a sound field effect produced through the processing by the vector decomposition processing portion 103R.

The vector decomposition processing portion 103L causes the sound source position information that has been read-out from the memory portion 102 to be rotated around the listening position by 45° in the left direction, thereby offsetting localization positions of the group of pseudo sound reflections in the left direction. This causes the pseudo sound reflection 101 having been localized on the left side in front of the listening position G (at an angle near)−15° to be moved in the left direction (to an angle near)−60°. Accordingly, the domain 100 having the sound field effect in front of the listening position G as shown in FIG. 3 is offset by −45° in the left direction of the listening position G through the processing by the vector decomposition processing portion 103L.

The vector decomposition processing portion 103R causes the sound source position information that has been read-out from the memory portion 102 to be rotated around the listening position by 45° in the right direction, thereby offsetting localization positions of the group of pseudo sound reflections in the right direction. This causes the pseudo sound reflection 101 having been localized on the left side in front of the listening position G (at an angle near −15°) to be moved in the right direction (to an angle near 30°). Accordingly, the domain 100 having the sound field effect in front of the listening position G, as shown in FIG. 3, is offset by 45° in the right direction of the listening position G through the processing by the vector decomposition processing portion 103R.

Figure 6:
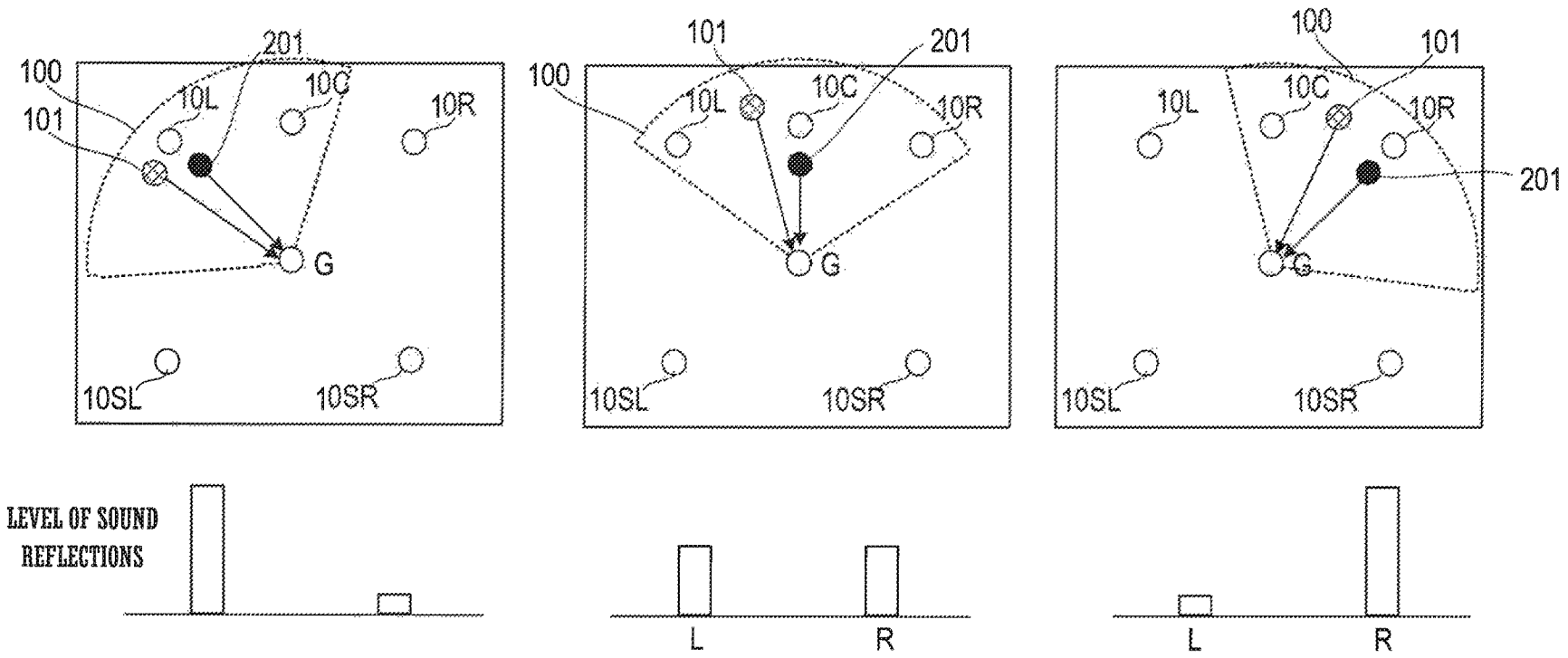
FIG. 6 is a diagram showing a state in which a direct sound and a pseudo sound reflection move.

FIG. 6 is a diagram showing a state in which a direct sound and a pseudo sound reflection move. For example, in a case where there is a high level of input in the audio signal for the FL channel, a sound source 201 of the direct sound is localized in a direction where the speaker 10L is installed. In this case, because a high level of audio signal is inputted to the vector decomposition processing portion 103L, as shown in FIG. 4, the pseudo sound reflection 101 is localized at an angle near −60° on the left side of the listening position G. Because a level of the audio signal for the FR channel is low, it never occurs that the pseudo sound reflection 101 is localized through the processing by the vector decomposition processing portion 103R.

In a case where there is a high level of input in the audio signal for the FR channel, the sound source 201 of the direct sound is localized in a direction where the speaker 10R is installed. In this case, because a high level of audio signal is inputted to the vector decomposition processing portion 103R, as shown in FIG. 5, the pseudo sound reflection 101 is localized at an angle near 30° on the right side of the listening position G. Because a level of the audio signal for the FL channel is low, it never occurs that the pseudo sound reflection 101 is localized through the processing by the vector decomposition processing portion 103L.

Figure 7:
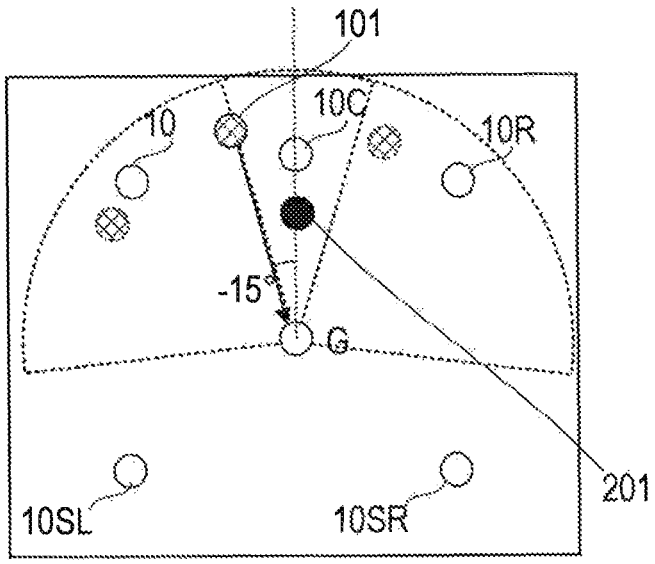
FIG. 7 is a diagram showing localization of the direct sound and the pseudo sound reflection in a case where components that are in-phase are inputted.

Then, in a case where there are high levels of inputs in both of the audio signals for the FL channel and for the FR channel, that is, where audio signals having in-phase components are inputted to both of the channels, as shown in FIG. 7, the sound source 201 of the direct sound is localized as a phantom sound source in front of the listening position G. In this case, because high levels of audio signals are inputted to the vector decomposition processing portion 103L and the vector decomposition processing portion 103R, respectively, the pseudo sound reflection 101 is localized as a phantom sound source at an angle near −15° on the left side in front of the listening position G which is original position.

Therefore, as shown in FIG. 6, when, for example, the localization position of the sound source 201 of the direct sound moves from the left front direction of the listening position G, through the front, to the right direction thereof, it follows that the localization position of the pseudo sound reflection 101 also moves from the left front direction of the listening position G, through the front, to the right direction thereof. That is to say, the domain 100 having the sound field effect moves following the movement of the sound source position of the direct sound.

In this manner, the audio signal processing apparatus 1 of this embodiment makes it possible to produce a sense of direction also in the sound field effect, by changing the sound source positions of the group of sound reflections.

Also, since the audio signal processing apparatus 1 changes the localization positions of the pseudo sound reflections through the process of changing the sound source position information, preparation of separate sound source position information for each direction is not required. In other words, because the vector decomposition processing portion 103L and the vector decomposition processing portion 103R respectively read out the same sound source position information, it is not necessary to prepare separate sound source position information for each of the vector decomposition processing portion 103L and the vector decomposition processing portion 103R. Thus, the audio signal processing apparatus 1 of this embodiment makes it possible to produce a sense of direction in the sound field effect by changing the sound source positions of the group of sound reflections, without increasing the amount of data on the sound source position information (and impulse response).

Figure 11:
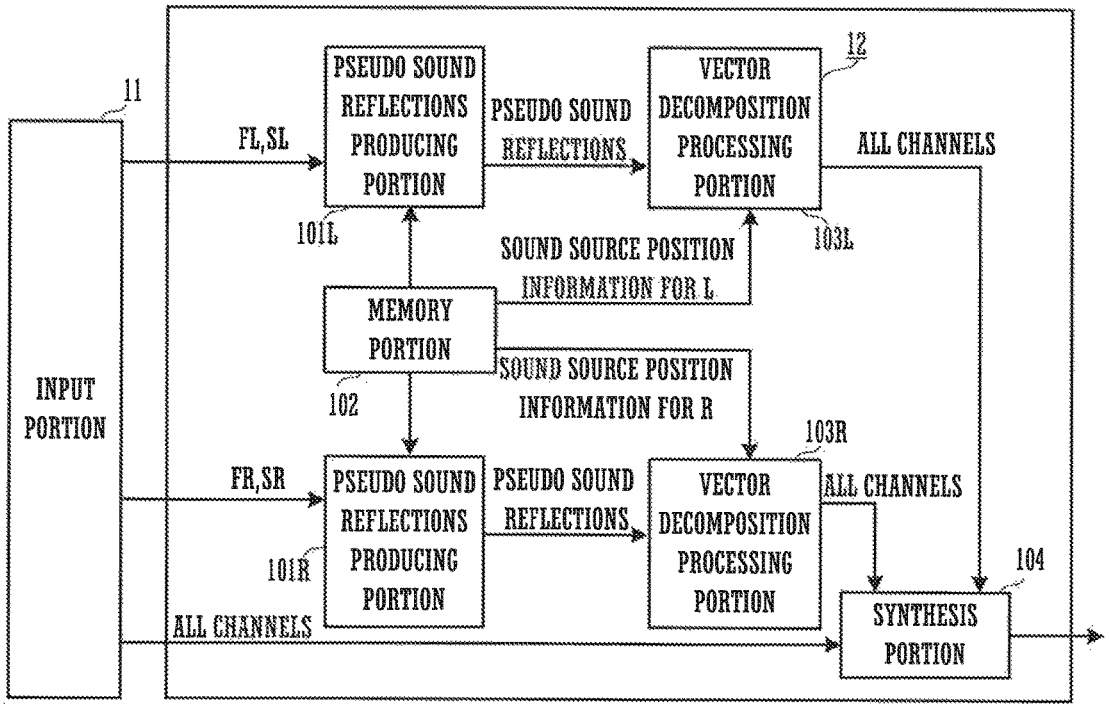
FIG. 11 is a functional block diagram of the processing portion in a case where sound source position information that is offset beforehand is prepared.

However, the memory portion 102 may store separate sound source position information for each direction. For example, the memory portion 102 stores, as shown in FIG. 11, sound source position information for L and sound source position information for R. The sound source position information for L is one in which sound source position information of pseudo sound reflections in an acoustic space is offset in the left direction (for example, rotated by 45° in the left direction) beforehand. The sound source position information for R is one in which sound source position information of pseudo sound reflections in an acoustic space is offset in the right direction (for example, rotated by 45° in the right direction) beforehand. The vector decomposition processing portion 103L reads out the source position information for L, and the vector decomposition processing portion 103R reads out the source position information for R. Also in this case, the audio signal processing apparatus 1 makes it possible to produce a sense of direction in the sound field effect, by changing the sound source positions of the group of sound reflections.

Figure 8:
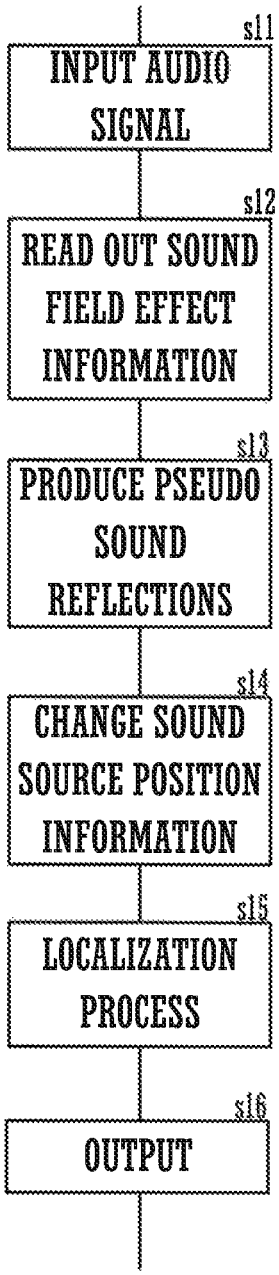
FIG. 8 is a flow chart showing an operation of the audio signal processing apparatus.

Subsequently, FIG. 8 is a flow chart showing an operation of the audio signal processing apparatus. The audio signal processing apparatus 1 first performs inputting of an audio signal (s11). In other words, the audio signal is inputted to the processing portion 12.

Then, the processing portion 12 reads out the sound field effect information (s12). The pseudo sound reflection producing portion 101L and the pseudo sound reflection producing portion 101R read out the impulse response, and the vector decomposition processing portion 103L and the vector decomposition processing portion 103R read out the sound source position information.

Next, the pseudo sound reflection producing portion 101L and the pseudo sound reflection producing portion 101R produce pseudo sound reflections, based on the respectively read-out impulse response (s13). After that, the vector decomposition processing portion 103L and the vector decomposition processing portion 103R change the respectively read-out sound source position information (s14).

As mentioned above, the vector decomposition processing portion 103L causes the read-out sound source position information to be rotated around the listening position G by 45° in the left direction. The vector decomposition processing portion 103R causes the read-out sound source position information to be rotated around the listening position G by 45° in the right direction.

However, procedure to offset the sound source position information is not necessarily limited to this example. For example, the sound source position information may be rotated in ideal directions for the installation of speakers as defined by the ITU recommendations (for example, 30° in the right direction and 30° in the left direction). Also, the sound source position information may be rotated in directions manually set by a user.

Still, it is ideal to carry out the offset in directions in which speakers are actually installed. Then, the audio signal processing apparatus 1 also makes it possible to determine an arrangement of the speakers, by outputting a sound for measurement from speakers of respective channels and picking up the sound for measurement with a microphone (not shown) installed at the listening position G. For example, as disclosed in JP 2009-037143 A, by carrying out the measurement at least at three positions, the audio signal processing apparatus 1 can determine exact locations of the respective speakers. In this case, the audio signal processing apparatus 1 can offset the sound source position information according to the arrangement of the speakers determined from the sound for measurement.

Figure 9:
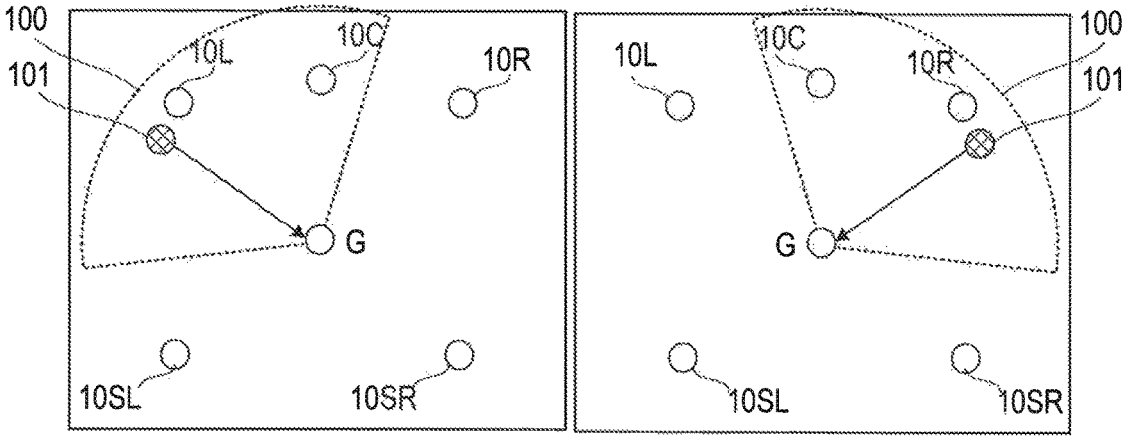
FIG. 9 is a top view schematically showing a listening environment in a case where the sound source position information is inverted.

Further, instead of rotation, inversion may be embodied as another procedure for offsetting, for example, as shown in FIG. 9. However, in a case where the sound source moves continuously to the right and to the left, the pseudo sound reflections move more naturally when the sound source position information is rotated than when it is inverted; therefore, using the rotation can provide the user with a more natural feeling of movement of the sound field effect.

Returning to FIG. 8, the vector decomposition processing portion 103L and the vector decomposition processing portion 103R perform the process of localizing the pseudo sound reflections, based on the sound source position information that has been changed in the above-mentioned manner (s15). Finally, the synthesis portion 104 combines the audio signals output from the vector decomposition processing portion 103L and the vector decomposition processing portion 103R with the audio signals inputted from the input portion 11, for the respective channels, and outputs the audio signals for the respective channels that have been synthesized to the output portion 13 (s16).

Here, in this embodiment, the pseudo sound reflections are produced and localized for the right side channels and for the left side channels, respectively; however, since the sound source position information is offset in the right direction and in the left direction respectively even when a monaural signal that is down-mixed from the audio signals for all the channels is used, the pseudo sound reflections for the right side channels and the pseudo sound reflections for the left side channels are respectively produced. Thus, even when the signal that is inputted is a monaural signal, the audio signal processing apparatus 1 can produce a sense of direction in the sound field effect. Although an example in which 5-channel audio signals are inputted is shown in this embodiment, the present invention can be implemented also in cases where 2-channel, 7-channel audio signals or the like is inputted. The present invention can be applied to audio signals of any number of channels to be inputted, as long as the number of speakers is more than one.

Here, the audio signal processing apparatus 1 of this embodiment performs the process of producing, for a first channel, the pseudo sound reflections that are offset in the left direction by combining an audio signal for the FL channel with an audio signal for the SL channel, and producing, for a second channel, the pseudo sound reflections that are offset in the right direction by combining an audio signal for the FR channel with an audio signal for the SR channel. However, the same sound source position information may be offset toward front and rear, by combining the FL channel with the FR channel as a first channel, and combing the SL channel with the SR channel as a second channel, respectively. Also, for example, a process of offsetting the sound source position information may be performed by separately producing pseudo sound reflections for respective channels.

However, because the distance between the front side speakers and the surround side speakers is longer than the distance between the right side speakers and the left side speakers, a feeling of connection between the front and the rear may be diluted when the front side and the surround side are processed separately. Therefore, it is preferable for the audio signal processing apparatus 1 to produce the pseudo sound reflections by combining the audio signal for the front side with the audio signal for the surround side to represent a connection between the front and the rear more naturally.

Figure 10:
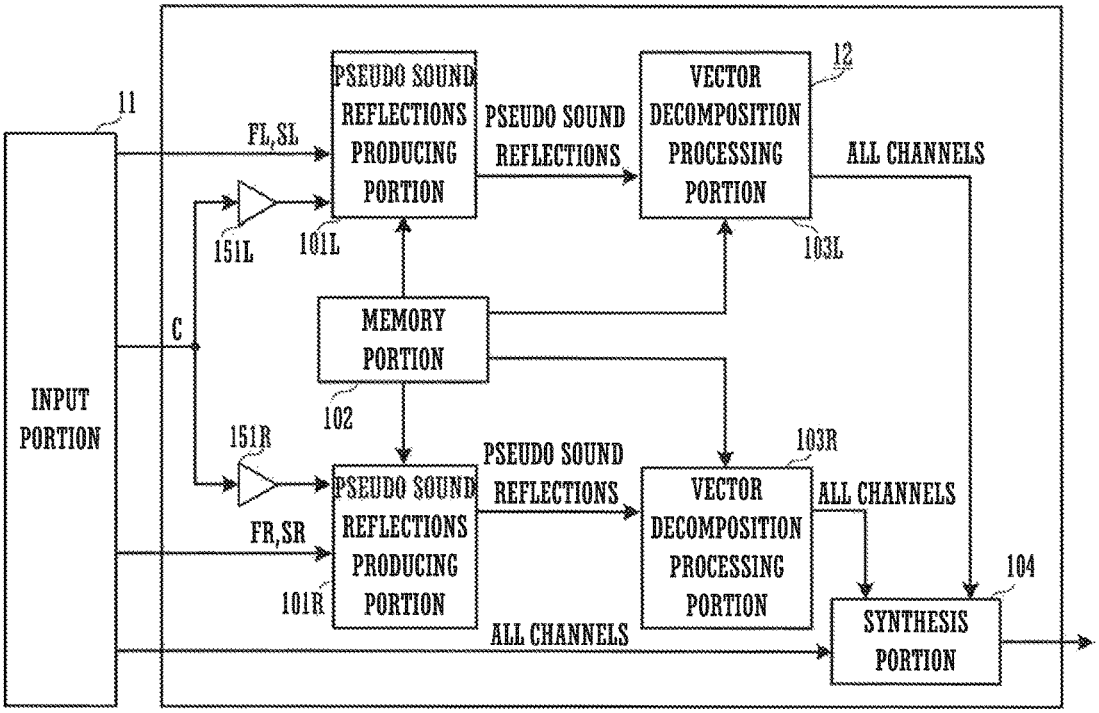
FIG. 10 is a functional block diagram of the processing portion in a case where an audio signal for C channel is inputted.

Also, the audio signal processing apparatus 1, as shown in FIG. 10, may distribute an audio signal for a C channel as a third signal to the audio signal for the first channel (FL channel and SL channel), and to the audio signal for the second channel (FR channel and SR channel).

In this case, the audio signal for the C channel is distributed to a gain adjuster 151L and a gain adjuster 151R. The distributed audio signal for the C channel undergoes gain adjustment at the gain adjuster 151L and the gain adjuster 151R, respectively, and is inputted to the pseudo sound reflection producing portion 101L and the pseudo sound reflection producing portion 101R, respectively.

This results in formation of a steady sound field effect also in front of the listening position, in addition to the sound field effect that is offset in the left direction and the sound field effect that is offset in the right direction. Thus, it follows that connection between the right and the left is strengthened further.

Moreover, in a case where an audio signal for a surround back channel is inputted in addition to the audio signals for the SL channel and the SR channel, the audio signal for the surround back channel may also be distributed to the SL channel and the SR channel in the same manner as in the case of C channel. This also results in formation of a steady sound field effect in the rear of the listening position G.

Figure 12:
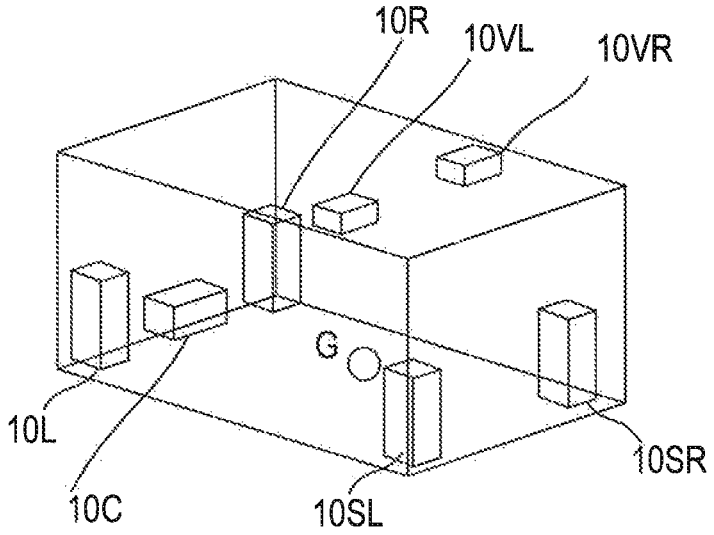
FIG. 12 is a pictorial drawing schematically showing a listening environment.
Figure 13A:
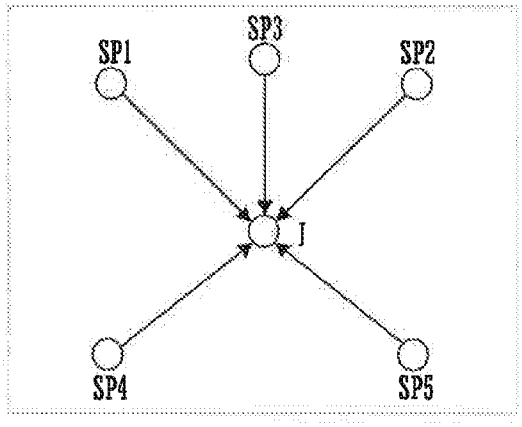
Fig.13A Prior Art
FIG. 13A is a top view schematically showing a listening environment.
Figure 13B:
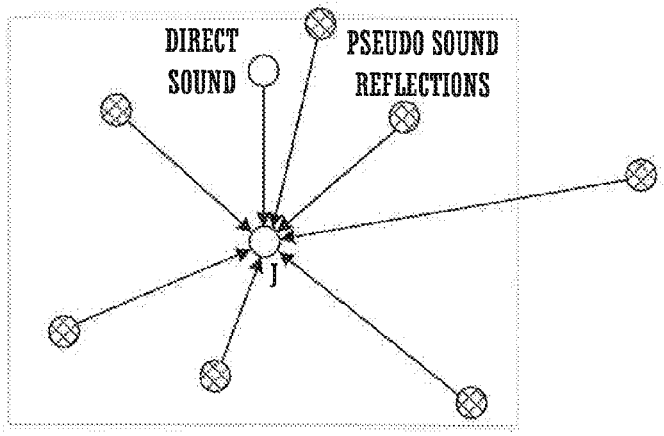
Fig.13B Prior Art
FIG. 13B is a conceptual diagram showing a sound source distribution of a direct sound and pseudo sound reflections in a case where a sound field effect is provided.
Figure 13C:
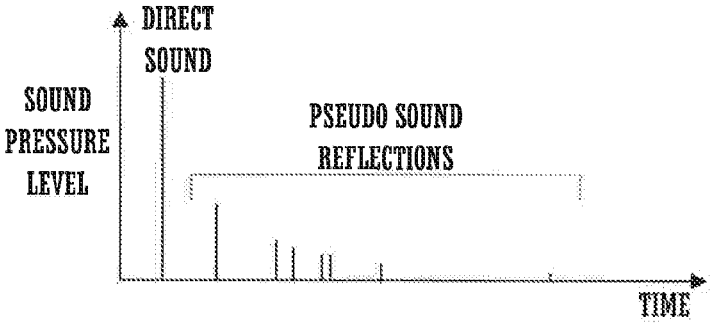
Fig.13C Prior Art
FIG. 13C is a diagram showing an impulse response of an acoustic space.

Further, the sound field effect is not limited to one that is produced on the same plane. For example, as shown in a pictorial drawing in FIG. 12, in a case where speakers 10VL and 10VR are installed above the listening position G, the sound source position of the direct sound is localized in three dimensions. In this case, the sound source position information includes information showing three-dimensional positions (for example, horizontal direction and vertical direction from the listening position G) of the group of sound reflections. The vector decomposition processing portions 103 L and 103R change distribution gain ratios for the audio signals to be supplied to the respective speakers including the speakers 10VL and 10VR based on the sound source position information, thereby localizing the pseudo sound reflections in three dimensions. Then, the sound source position information is offset in three dimensional directions including vertical direction. Either the memory portion 102 may store the sound source position information having been offset beforehand, or the vector decomposition processing portions 103 L and 103R may perform the process of offsetting. This enables the audio signal processing apparatus 1 to produce a three-dimensional sense of direction in the sound field effect.

What is claimed is:

1. A sound effect producing apparatus comprising:

a memory storing sound effect information that includes production information for producing a pseudo sound reflection corresponding to a sound reflection generated in a predetermined acoustic space and sound source position information showing a sound source position of the pseudo sound reflection;

a processing portion including a processor configured to execute a plurality of tasks, including:

a pseudo sound reflection producing task that produces the pseudo sound reflection based on the production information; and an effect provision task that localizes the pseudo sound reflection using a predetermined direction as a reference by changing the sound source position information stored in the memory.

2. The sound effect producing apparatus according to claim 1, wherein:

the memory stores a plurality of pieces of the sound source position information with respect to different directions defined as references, and the effect provision task reads out the plurality of pieces of the sound source position information and localizes the pseudo sound reflection using the directions corresponding to the respective pieces of the sound source position information as references.

3. The sound effect producing apparatus according to claim 1, further comprising:

an input interface that provides inputs for a first channel and a second channel, wherein the pseudo sound reflection producing task produces the pseudo sound reflections for an audio signal for the first channel and for an audio signal for the second channel, respectively, and wherein the effect provision task changes the sound source position information using directions respectively corresponding to the first and second channels as references.

4. The sound effect producing apparatus according to claim 3, wherein:

the input interface further provides an input for a third channel, and the pseudo sound reflection producing task produces the pseudo sound reflections respectively for the audio signal for the first channel based on both the audio signal for the first channel and the audio signal for the third channel and for the audio signal for the second channel based on both the audio signal for the second channel and the audio signal for the third channel.

5. The sound effect producing apparatus according to claim 1, wherein the effect provision task causes the sound source position information to be rotated around a listening position by a predetermined angle.

6. The sound effect producing apparatus according to claim 1, wherein the predetermined direction corresponds to a direction in which a speaker is installed.

7. A method of producing a sound effect using a processor of an information processing apparatus, the method comprising the steps of:

storing, in a memory, sound effect information that includes production information for producing a pseudo sound reflection corresponding to a sound reflection generated in a predetermined acoustic space and sound source position information showing a sound source position of the pseudo sound reflection;

producing, with the processor, the pseudo sound reflection based on the production information; and performing, with the processor, a process of localizing the pseudo sound reflection using a predetermined direction as a reference by changing the sound source position information stored in the memory.

8. The method of producing a sound effect according to claim 7, wherein:

the storing step stores, in the memory, a plurality of pieces of the sound source position information with respect to different directions defined as references, and the performing step reads out the plurality of pieces of the sound source position information and performs the process of localizing the pseudo sound reflection using the directions corresponding to the respective pieces of the sound source position information as references.

9. The method of producing a sound effect according to claim 7, further comprising the steps of:

inputting an audio signal for a first channel and an audio signal for a second channel, wherein the producing step produces the pseudo sound reflections respectively for the audio signal for the first channel and for the audio signal for the second channel, and wherein the performing step changes the sound source position information using directions respectively corresponding to the channels as references.

10. The method of producing a sound effect according to claim 9, wherein:

the inputting step further inputs an audio signal for a third channel, and the performing step produces the pseudo sound reflections respectively for the audio signal for the first channel based on the audio signal for the first channel and the audio signal for the third channel and for the audio signal for the second channel based on the audio signal for the second channel and the audio signal for the third channel.

11. The method of producing a sound effect according to claim 7, wherein the performing step rotates the sound source position information around a listening position by a predetermined angle.

12. The method of producing a sound effect according to claim 7, wherein the predetermined direction corresponds to a direction in which a speaker is installed.

13. A non-transitory medium storing a program executable by a processor of an information processing apparatus to execute a method comprising the steps of:

storing, in a memory, sound effect information that includes production information for producing a pseudo sound reflection corresponding to a sound reflection generated in a predetermined acoustic space and sound source position information showing a sound source position of the pseudo sound reflection;

producing the pseudo sound reflection based on the production information; and performing a process of localizing the pseudo sound reflection using a predetermined direction as a reference by changing the sound source position information stored in the memory.

* * * * *